US007650918B2

(12) United States Patent
Schiedegger et al.

(10) Patent No.: US 7,650,918 B2
(45) Date of Patent: Jan. 26, 2010

(54) METHOD OF MANUFACTURING A MODULAR SHUTTER ASSEMBLY

(75) Inventors: Charles E. Schiedegger, Metamora, MI (US); Richard Logan, Oxford, MI (US); Jeffrey Jaycox, Florence, SC (US); Jeff E. Schiedegger, Ann Arbor, MI (US)

(73) Assignee: Tapco International Corporation, Wixom, MI (US)

( * ) Notice: Subject to any disclaimer, the term of this patent is extended or adjusted under 35 U.S.C. 154(b) by 469 days.

(21) Appl. No.: 10/779,076

(22) Filed: Feb. 13, 2004

(65) Prior Publication Data

US 2004/0187398 A1 Sep. 30, 2004

Related U.S. Application Data

(60) Provisional application No. 60/447,370, filed on Feb. 14, 2003.

(51) Int. Cl.
*B27F 1/06* (2006.01)
*B27M 3/00* (2006.01)

(52) U.S. Cl. ..... 144/347; 144/5

(58) Field of Classification Search ..... 52/311.2, 52/314, 455, 457, 473, 475.1; 144/347, 354, 144/2.1, 3.1, 5; 428/167
See application file for complete search history.

(56) References Cited

U.S. PATENT DOCUMENTS

| | | | | | |
|---|---|---|---|---|---|
| 173,786 | A * | 2/1876 | Hayes | 454/280 |
| 1,908,313 | A * | 5/1933 | Brown | 52/552 |
| 3,055,467 | A * | 9/1962 | Peek et al. | 52/475.1 |
| 3,782,051 | A * | 1/1974 | Quinif | 52/473 |
| 4,097,100 | A * | 6/1978 | Sauder | 312/265.6 |
| 4,188,762 | A * | 2/1980 | Tellman | 52/541 |
| 4,251,966 | A * | 2/1981 | Foltman | 52/309.1 |
| 4,439,970 | A * | 4/1984 | Rosner | 52/511 |
| 4,702,054 | A * | 10/1987 | Turner | 52/455 |
| 4,884,379 | A * | 12/1989 | McCabe | 52/200 |
| D314,242 | S * | 1/1991 | Mikolaitis | D25/138 |
| 5,123,466 | A * | 6/1992 | Ellsworth | 144/372 |
| 5,761,865 | A * | 6/1998 | Schiedegger et al. | 52/473 |
| 5,782,055 | A * | 7/1998 | Crittenden | 52/784.1 |
| 5,848,505 | A * | 12/1998 | Taylor | 52/202 |
| 5,924,255 | A * | 7/1999 | Vagedes | 52/473 |
| 6,125,607 | A * | 10/2000 | Poce | 52/847 |
| 6,141,938 | A * | 11/2000 | Schiedegger | 52/745.19 |
| 6,311,445 | B1 * | 11/2001 | Macander et al. | 52/473 |
| 6,397,540 | B1 * | 6/2002 | Schiedegger | 52/311.2 |
| 6,536,162 | B2 * | 3/2003 | LaMay | 49/403 |
| 6,560,941 | B1 * | 5/2003 | French | 52/473 |
| 6,701,669 | B1 * | 3/2004 | Yorgason | 49/82.1 |
| 6,810,619 | B2 * | 11/2004 | Wilson | 49/74.1 |
| 6,810,620 | B1 * | 11/2004 | Anderson et al. | 49/74.1 |
| 6,901,701 | B2 * | 6/2005 | Lee | 49/82.1 |
| 2004/0000102 | A1 * | 1/2004 | Smerud | 52/85 |
| 2005/0204668 | A1 * | 9/2005 | Buchwald | 52/473 |
| 2006/0174550 | A1 * | 8/2006 | Smerud et al. | 52/86 |

* cited by examiner

*Primary Examiner*—Gay Ann Spahn
(74) *Attorney, Agent, or Firm*—Howard & Howard Attorneys PLLC

(57) ABSTRACT

A modular louvered shutter includes first and second stiles and a center section assembled using a tongue and groove joint. The center section is a solid piece have a plurality of rails and louvers cut into the center section.

6 Claims, 18 Drawing Sheets

METHOD OF MANUFACTURING A MODULAR SHUTTER ASSEMBLY

This application claims priority to U.S. Provisional Patent Application Ser. No. 60/447,370 filed Feb. 14, 2003.

TECHNICAL FIELD

The present invention relates generally to shutters, and more particularly to a modular paneled shutter assembly and method of manufacturing the same.

BACKGROUND OF THE INVENTION

Many different modem building designs take advantage of modular shutters for purely aesthetic purposes to decorate exterior windows. One type of shutter is the louvered shutter. Typically, louvered shutters include a plurality of louvers. Each louver is an individual piece which is spaced from the other louvers. Since each individual louver is separate, it must be individual formed or cut from the others. Additionally, the handling of the individual pieces during assembly of the shutter increase the complexity, and thus the cost of assembly.

The present invention is aimed at one or more of the problems set forth above.

SUMMARY OF THE INVENTION AND ADVANTAGES

A modular louvered shutter includes first and second stiles and a center section assembled using a tongue and groove joint. The center section is a solid piece have a plurality of rails and louvers cut into the center section.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
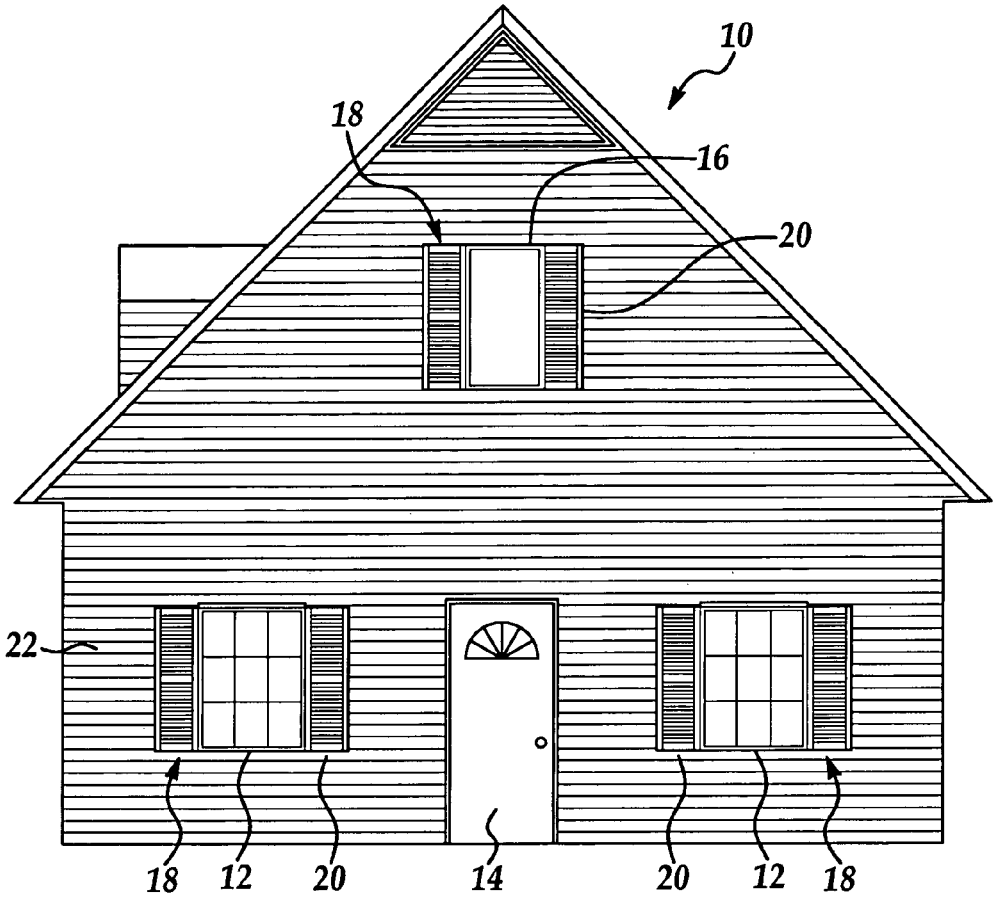
FIG. 1 is a front view of a housing including a louvered shutter, according to an embodiment of the present invention.

With reference to the drawings, the present invention provides a modular louvered shutter or shutter assembly 18. FIG. 1 shows an exterior front view of a house 10 that includes two lower story front windows 12 positioned on opposite sides of a door 14 and an upper story front window 16. The layout and style of the windows, 12, 16 show different types of popular window designs for different types of houses or other buildings. Positioned on both sides of each of the windows 12, 16 is a modular louvered shutter assembly 18 where each shutter assembly 18 includes a plurality of panels 20. The modular shutter assemblies 18 are rigidly secured to a front wall 22 of the house 10 by appropriate securing devices (not shown) known in the art at a location that at a location that aesthetically accents the windows 12, 16.

In one aspect of the present invention, the shutters 18 are made from an exterior grade composite wood product. However, other materials may also be used. After assembly, the shutters 18 are covered with a sealer and paint.

Figure 2:
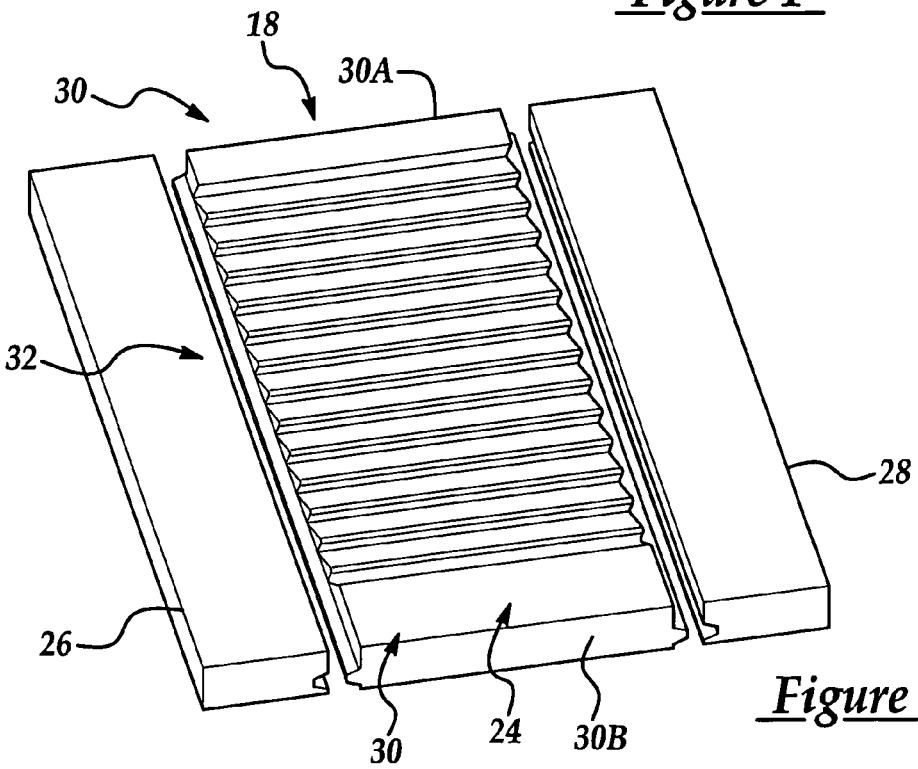
FIG. 2 is a three-dimensional view of the components of the shutter of FIG. 1.
Figure 4:
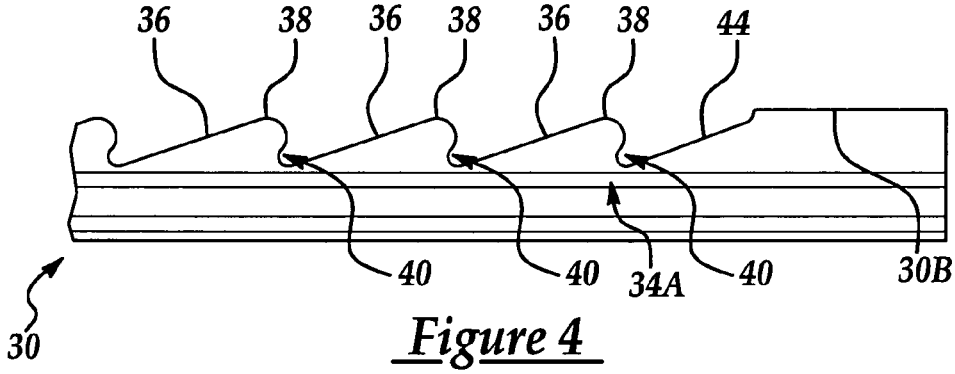
FIG. 4 is a three-dimensional side view of the shutter of FIG. 1.
Figure 5:
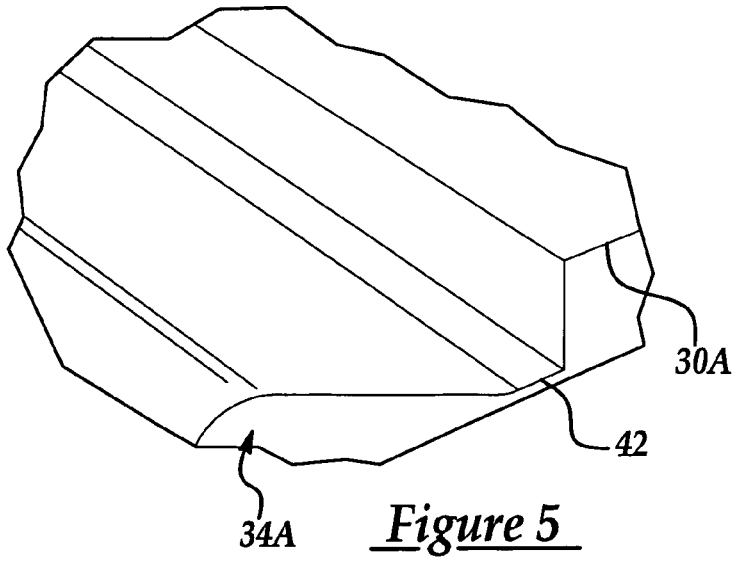
FIG. 5 is an illustration of a portion of the shutter of FIG. 1.
Figure 6:
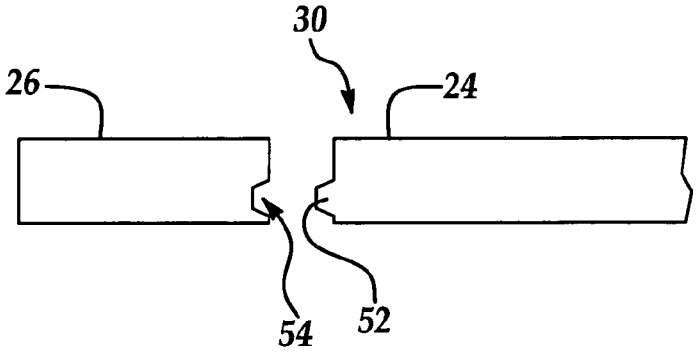
FIG. 6 is a side view of a stile and center section of the shutter of FIG. 1.

With reference to FIGS. 2, 4 and 5, each shutter 18 includes a center section 24 and first and second stiles 26, 28. The center section 24 is a single piece and includes one or more rails 30 and at least one louver section 30. The number of rails 32 is typically dependent upon the desired look of the shutter 18 and its length. For example, a shutter 18 which is less then 36 inches in height may have a top rail 30A and a bottom rail 30B and a single louver section 32 (as shown in FIG. 2). Shutters 18 longer than 36 inches in height may include a center rail and two louver sections (see FIG. 1).

As shown, the louver section 32 includes a plurality of integral louvers 34. As shown in FIG. 4, each louver 34 has a sloped portion 36 and a curved portion 38. Each louver 34 also includes a relief 40 adjacent the curved portion and opposite the sloped portion 36. The relief 40 provides the look of a true louvered shutter. In other words, the relief 40 creates an optical illusion that each louver 34 is separately formed.

The shutter 18 may also include a flat transition portion 42 between a top louver 34A and the top rail 30A and a ramped transition portion 44 between a bottom louver 34Z and the bottom rail 30B to further enhance the optical illusion.

Figure 3:
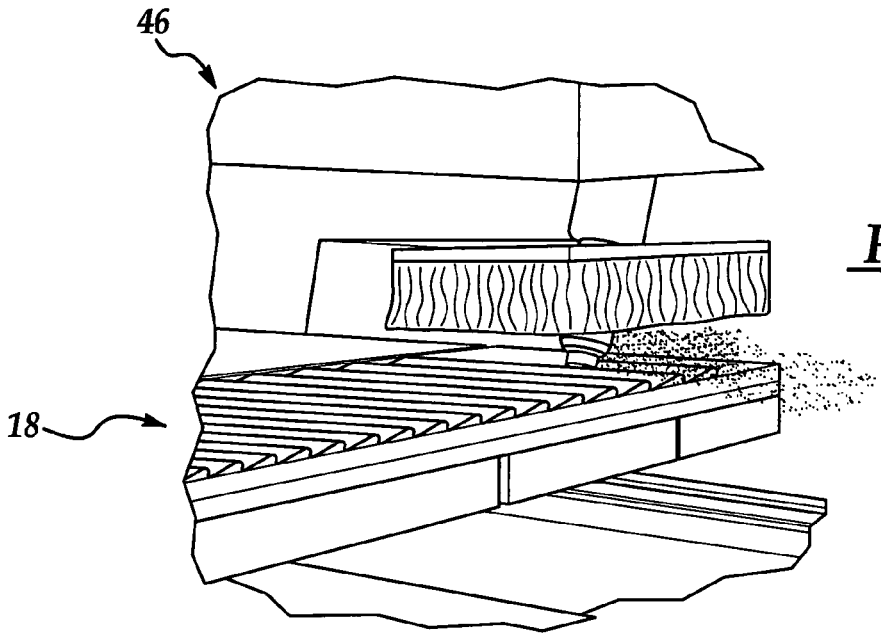
FIG. 3 is an illustration of a routing operation being performed, according to an embodiment of the present invention.

In one aspect of the present invention, the raw material from which the shutter 18 is made is in the form of sheet stock. The raw material is machined using a standard CNC routing machine 46 (see FIG. 3) and a plurality of different cutting tools.

In one embodiment, the raw material is machined into the components of the shutter 18, i.e., the stile 26, 28 and the center section 24 using a straight flute bit.

A second tool 48 is used to machine the louvers 34 in the center section 24. In one embodiment, the second tool 48 is a bull nose cutter (which is shaped like an hour glass). The second tool 48 is installed in an aggregate head which allows the cutting tool to be set at a specific angle, which may vary between different shutters (see FIG. 3). The second tool 48 cuts across the raw pre-cut center section 24 to start forming the louvers 30. In one embodiment, a set number of passes, e.g., 1-4, are necessary to complete one louver 30 and the undercut or relief 40 on the adjacent louver 30.

A third tool (not shown) is used to complete a finish cut, i.e., the flat transition portion around the rails 30 as necessary. The third tool may be a straight flute bit.

The side edges of the center section 24 are joined with edge of the first and second stiles 26, 28 using a tongue and groove joint 50. In the illustrated embodiment, a tongue 52 is machined into the edges of the center section 24 using a fourth tool or tongue cutter (not shown). A groove 54 is machined into an edge of each stile 26, 28 using a fifth tool. A fourth tool is then used to cut a tongue in the edges of the first and second stiles 26, 28.

Figure 7:
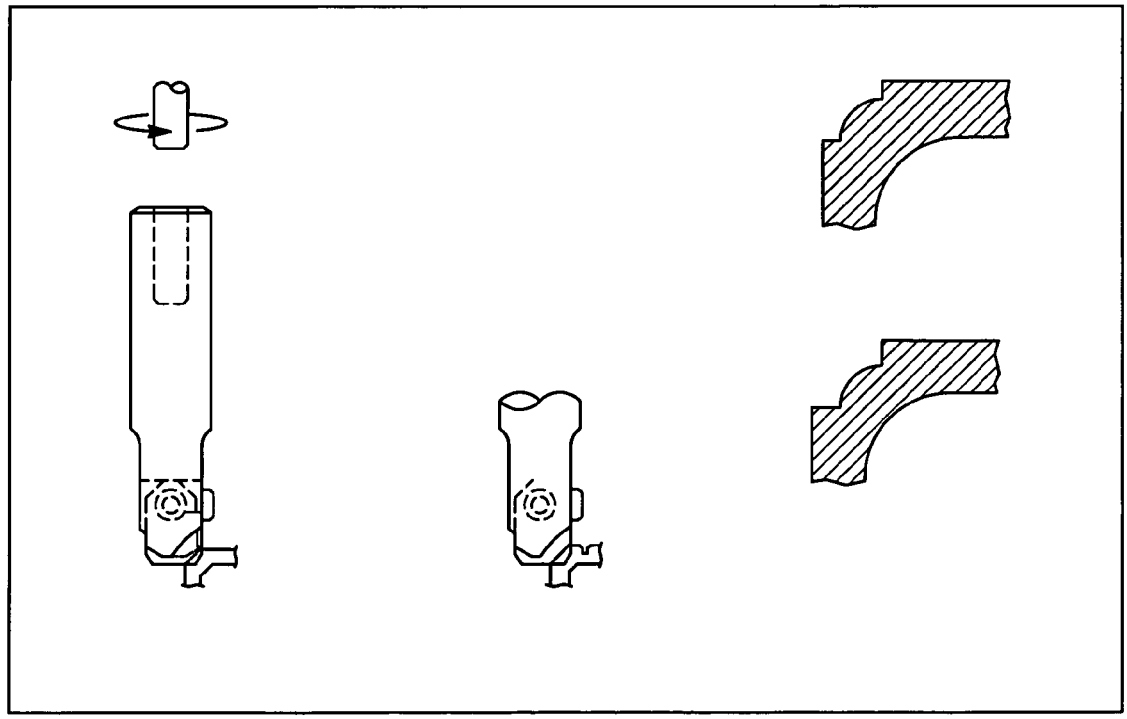
FIG. 7 is an illustration of a cutting tool used in the manufacture of the shutter of FIG. 1.
Figure 8:
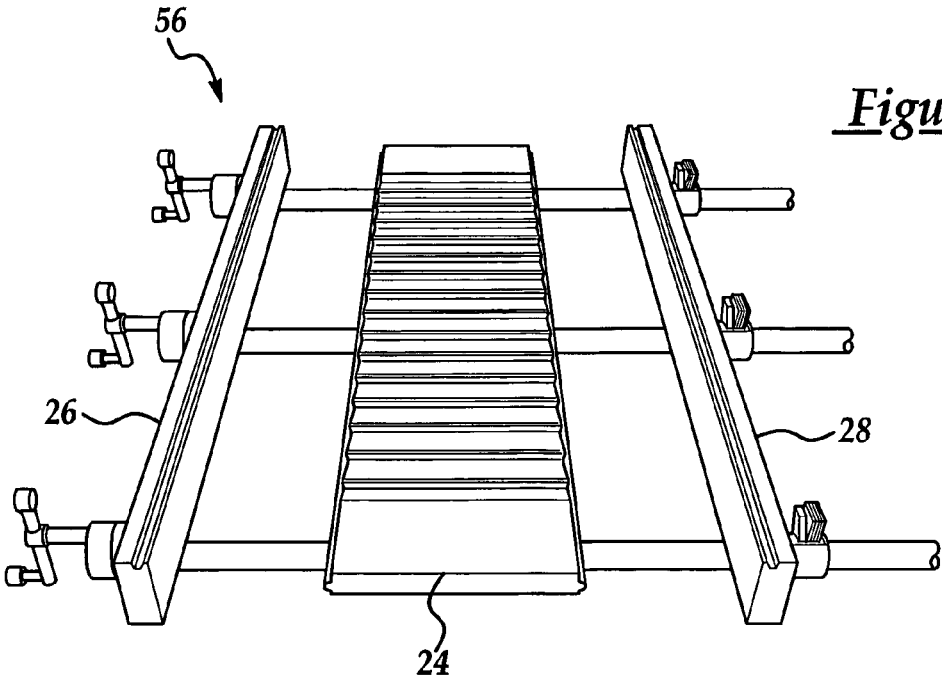
FIG. 8 is an illustration of the components of the shutter of FIG. 1 in a clamping system 56.
Figure 9:
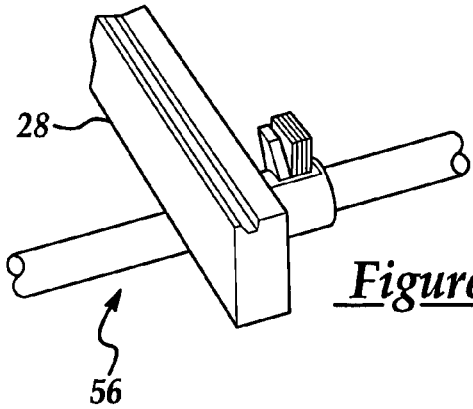
FIG. 9 is an illustration of a stile of the shutter of FIG. 1.
Figure 10:
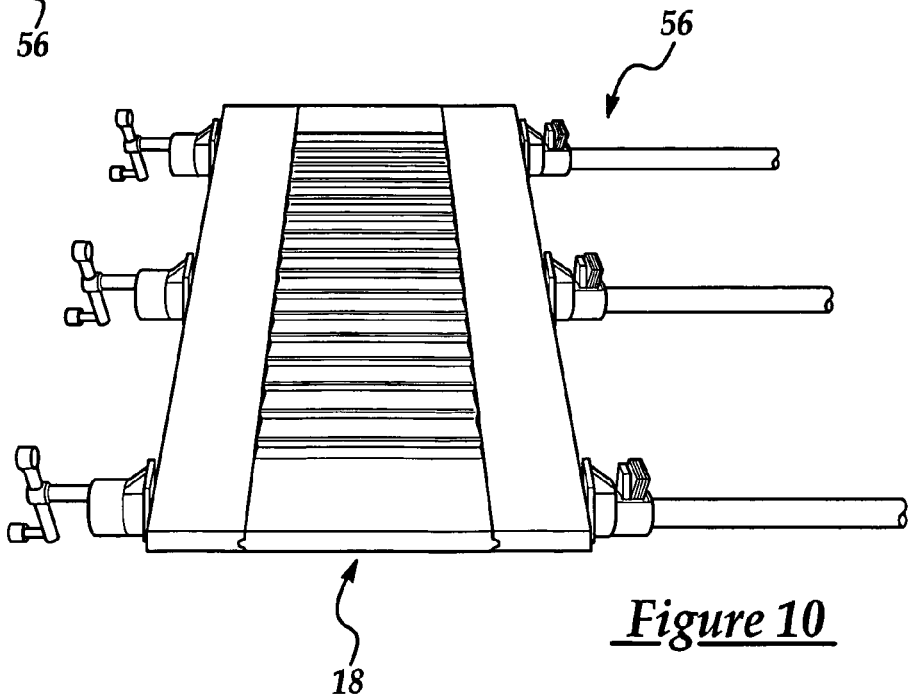
FIG. 10 is an illustrated of an assembled shutter in the clamping system of FIG. 8, according to an embodiment of the present invention.
Figure 11:
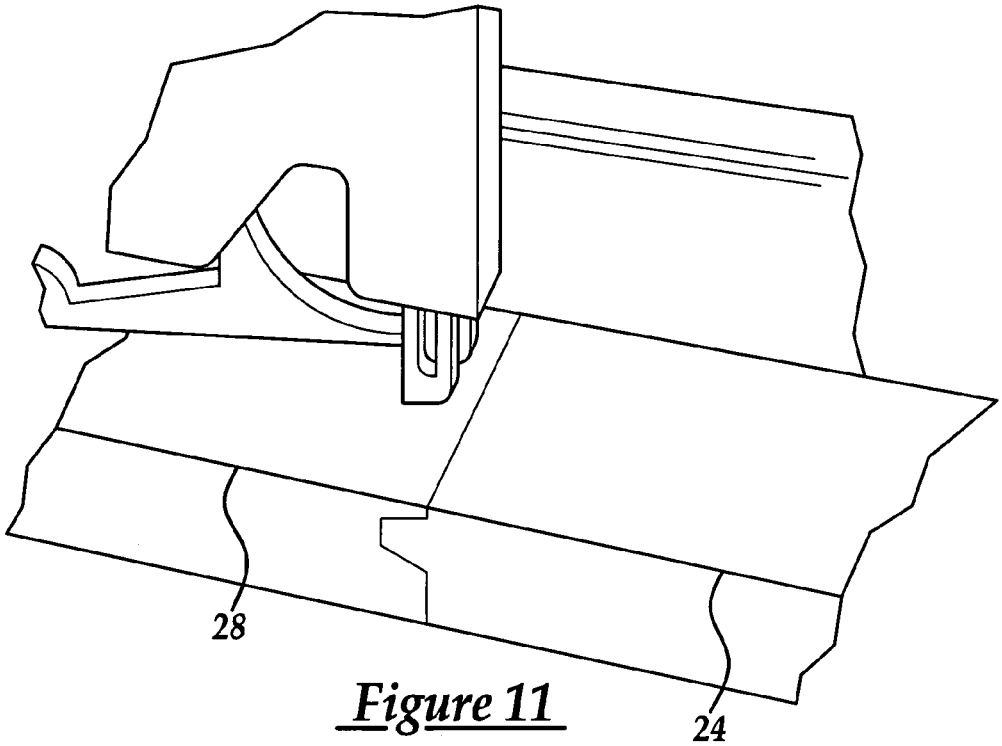
FIG. 11 is an illustration of a stapling operation.
Figure 12:
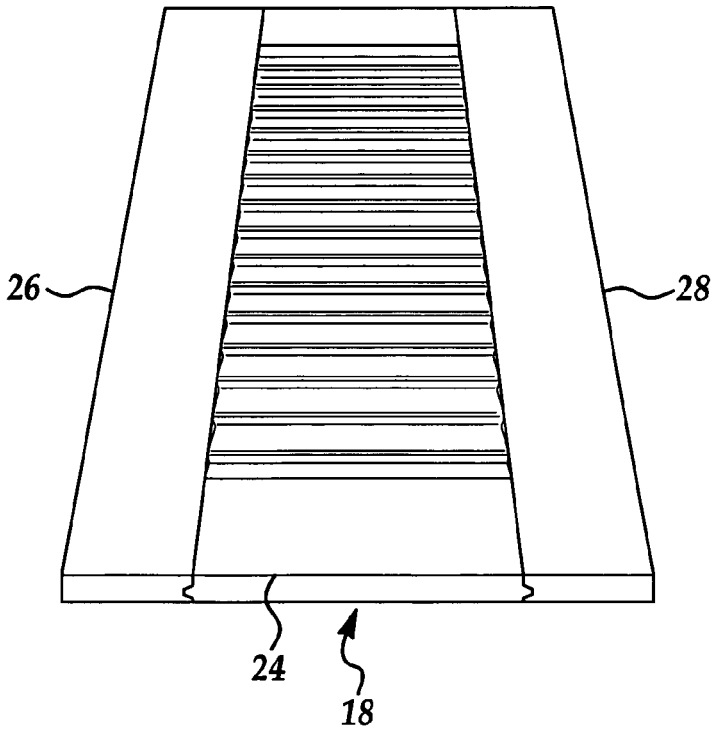
FIG. 12 is a three-dimensional view of the assembled shutter of FIG. 1.
Figure 13:
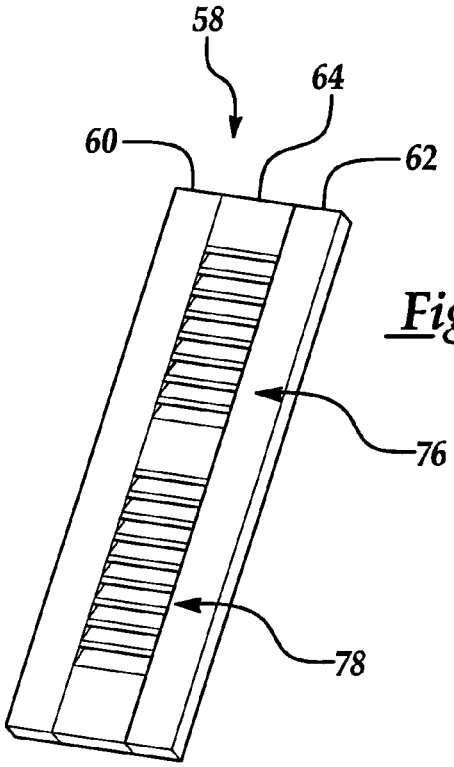
FIG. 13 is an illustration of a louvered shutter according to another embodiment of the present invention.

A sixth tool (see FIG. 7) may be used to machine a decorative beading along an inside and outside perimeter of the shutter 18. The components 24, 26, 28 are removed from the CNC machine 46 and any dust is removed. The components 24, 26, 28 are then placed in a clamping system 56 (see FIGS. 8, 9, and 10). Industrial grade wood glue is then applied along the inside of the grooves 54 (FIGS. 8 and 9). The stiles 26, 28 are then pressed on to the center section 24 by use of the clamping system 56. With the shutter 18 securely clamped, alignment of the stiles 26, 28 is checked and the assembly 18 is turned over. The assembly 18 may then be additionally secured by fastener (such as ⅝" long stainless steel brads) through the joints 50. In the illustrated embodiment, the steel brads are inserted using a pneumatic brad nailer or stapler 58. After the glue dries, the assembly 18 may then by sealed and painted.

Figure 14:
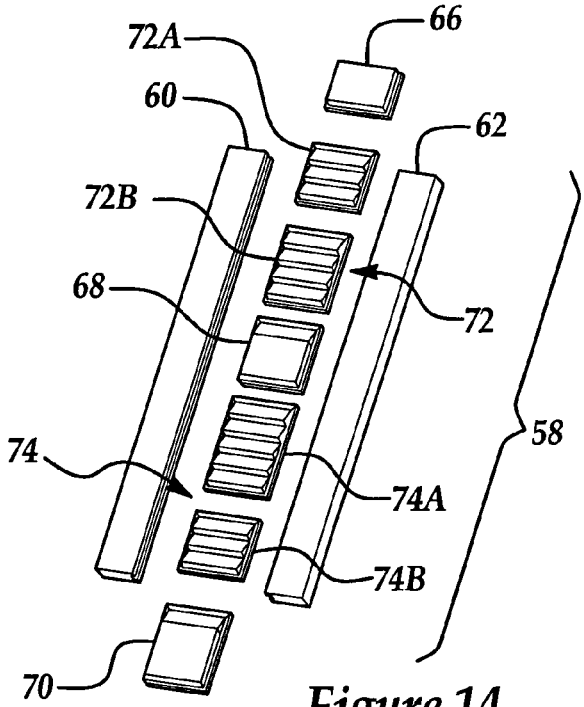
FIG. 14 is an exploded view drawing of the louvered shutter of FIG. 13.

With reference to FIGS. 13-25C, in a second embodiment of the present invention a louvered shutter 58 includes a first stile 60 and a second stile 62. A center section 64 is located between the first and second stile 60, 62. With specific reference to FIG. 14, the center section 64 includes a top rail 66, a center rail 68 and a bottom rail 70. At least one top louvered section 72 is located between the top rail 66 and the center rail 68. At least one bottom louvered section 74 is located between the center rail 68 and a bottom rail 70. The at least one top louvered section 72 forms a plurality of top louvers 76 as shown, in one embodiment the number of top louvers 76 is less than the number of bottom louvers 78.

In one aspect of the present invention, the number of louvers per each section 72, 74 may vary permitting the construction of shutters with variable lengths.

In the illustrated embodiment, the louver shutter 58 includes a first top louvered section 72A and a second top louvered section 72B. The first top louvered section 72A includes three louvers 76 and the second top louvered section 72B includes four louvers 76. The louvered shutter 58 also includes a first bottom louvered section 74A and a second bottom louvered section 74B. In the illustrated embodiment the first bottom louvered section 74A includes five louvers and the second bottom louvered section 74B includes three louvers. Louvered sections 72, 74 with varying number of louvers may be combined to provide a shutter 58 of a desired length.

Figure 15:
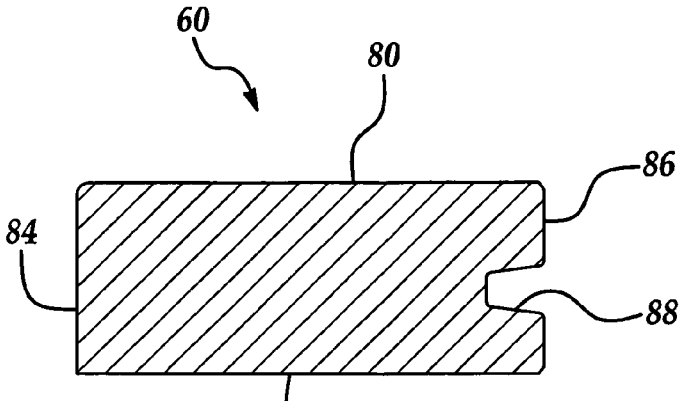
FIG. 15 is a side view of a stile of the louvered shutter of the FIG. 13.

With reference to FIG. 15, a cross sectional view of the first stile 60 is shown. The second stile 62 is a mirror image of the first stile 60. The first stile 60 has a front face 80 and a rear face 82. The first stile also includes a first side 84 and a second side 86. A first groove 88 is located at the second side 86 and traverses the length of the stile 60.

Figure 16A:
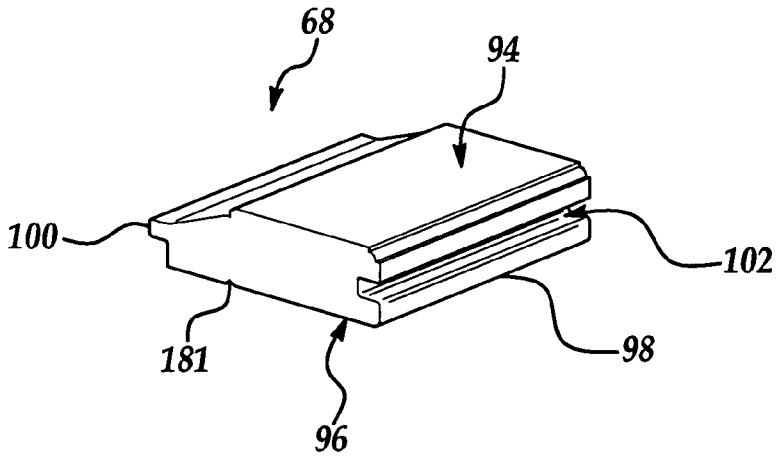
FIG. 16A is a diagrammatic illustration of a center rail of the louvered shutter of FIG. 13.
Figure 16B:
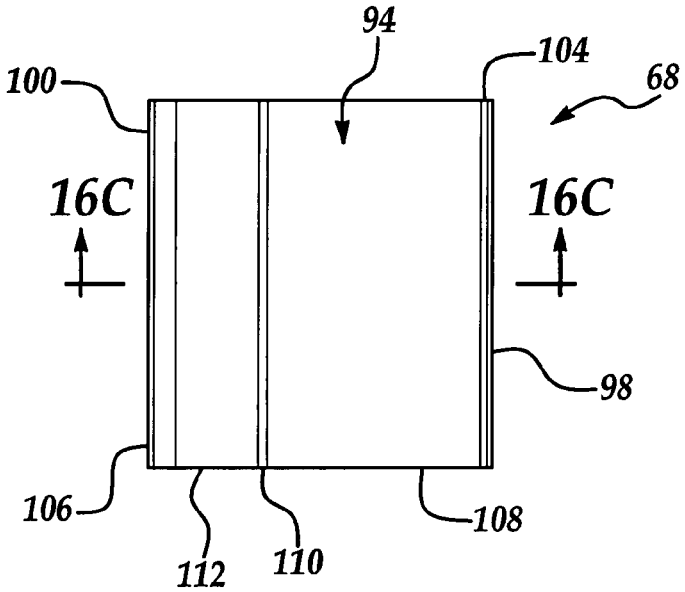
FIG. 16B is a top view of the center rail of FIG. 16A.
Figure 16C:
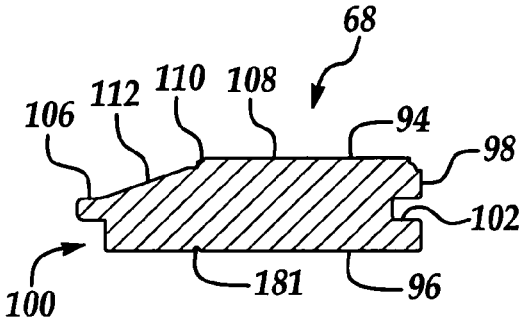
FIG. 16C is a cross-sectional view of the center rail of FIG. 16A.

With reference to FIG. 16A, 16B, 16C, the center rail 68 includes a front surface 94, a rear surface 96, a bottom side 98 and a top side 100. The bottom side 98 includes a groove or slot 102 traversing the width of the center rail 68. The edge between the bottom side 98 and the front surface 94 may have a decorative groove 104. The top side 100 includes a tab or tongue 106 traversing the width of the center rail 68. The front surface 94, in the illustrated embodiment includes a flat surface 108, a beveled or beaded edge 110, and an inclined surface 112.

Figure 17A:
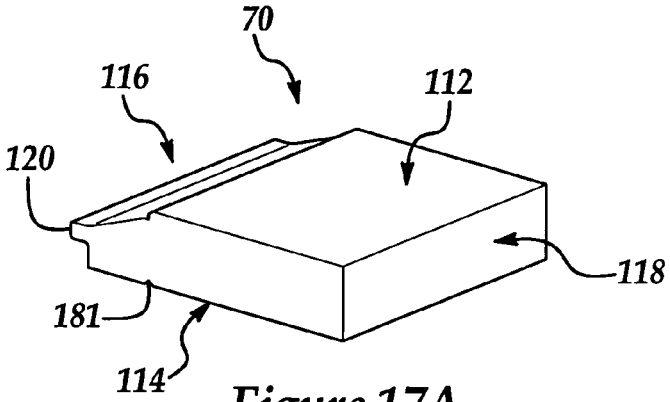
FIG. 17A is a diagrammatic illustration of a bottom rail of the louvered shutter of FIG. 13.
Figure 17B:
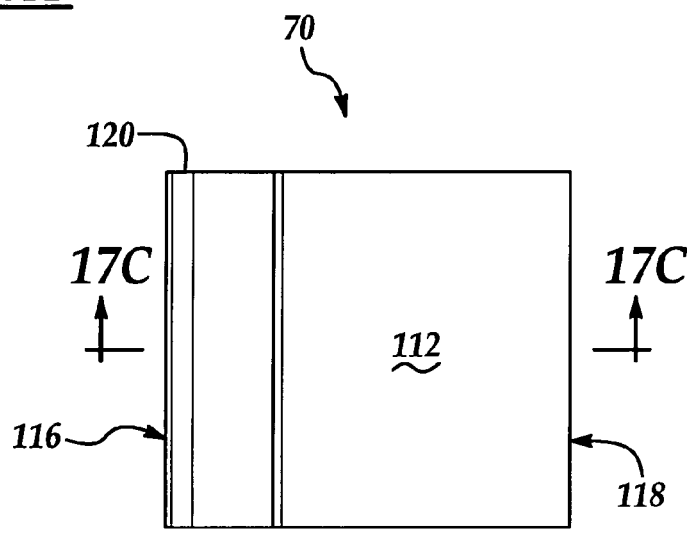
FIG. 17B is a top view of the bottom rail of FIG. 17A.
Figure 17C:
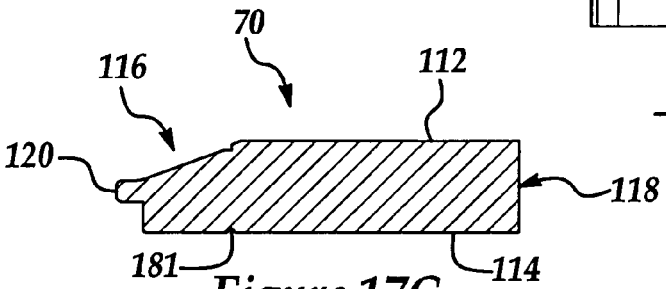
FIG. 17C is a cross sectional view of the bottom rail of FIG. 17A.
Figure 18:
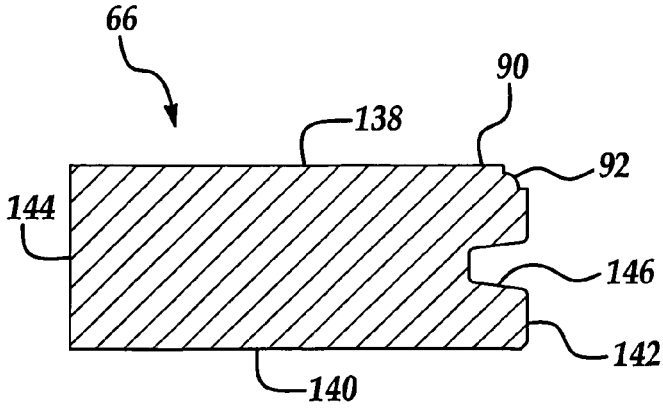
FIG. 18 is a cross-sectional view of a top rail of the louvered shutter of FIG. 13.

With reference to FIG. 17A, 17B, 17C, the bottom rail 70 includes a front surface 112, rear surface 114, a top side 116 and a bottom side 118. The top side 116 includes a tab or tongue 120 which traverses the width of the bottom rail 70. The front surface 112 includes a flat surface 122, a beveled or beaded edge 124 and an incline surface 126.

With reference to FIG. 8, the top rail 66, includes a front surface 138, a rear surface 140, a stop side 142 and a bottom side 144. The top side 142 has a groove or slot 146 traversing the width of the top rail 66. And edge 90 between the front surface 38 and the top side 142 may have a beveled or beaded edge 92.

Figure 19:
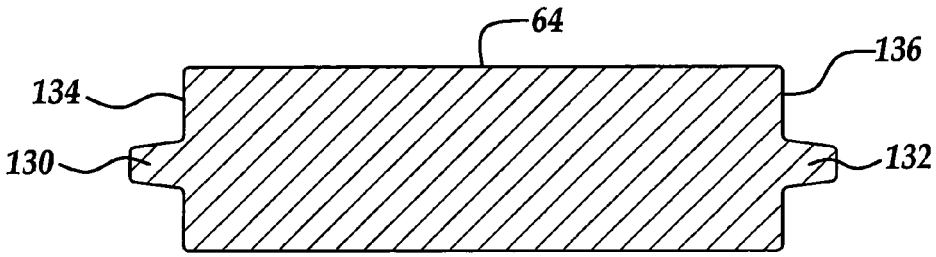
FIG. 19 is a cross-sectional view of a center section of the louvered shutter of FIG. 13.
Figure 20A:
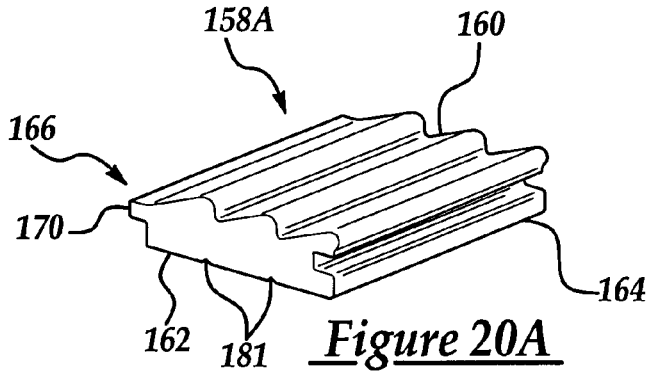
FIG. 20A is a diagrammatic illustration of a three-louver louvered section of the shutter of FIG. 13.
Figure 20B:
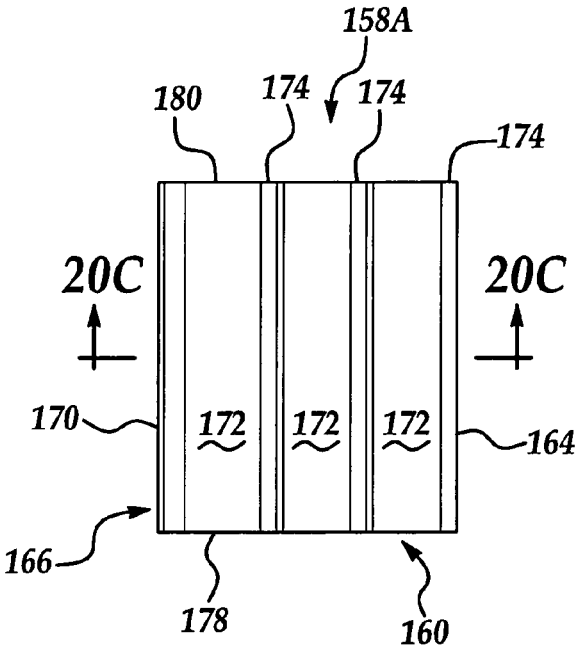
FIG. 20B is a top view of the louvered section of FIG. 20A.
Figure 20C:
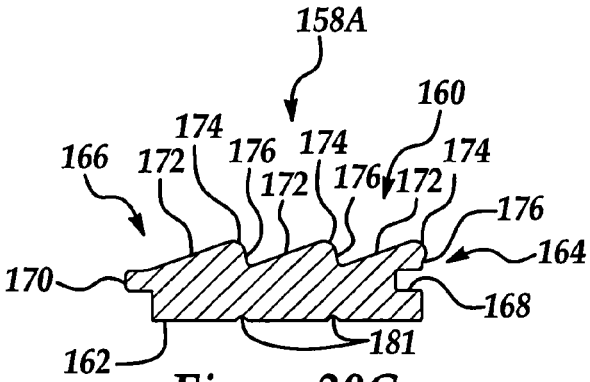
FIG. 20C is a cross sectional view of the louvered section of FIG. 20A.
Figure 21A:
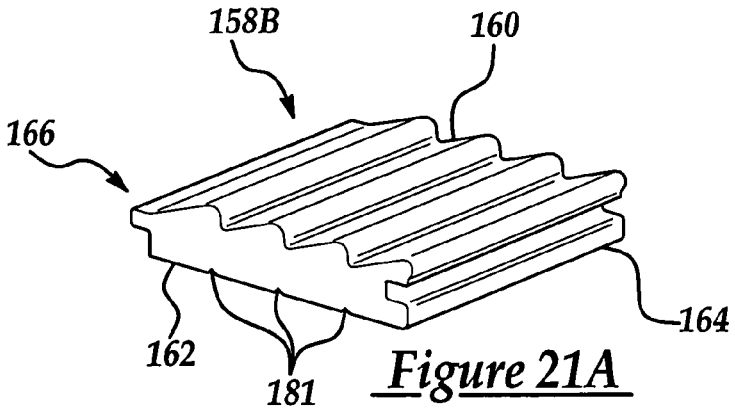
FIG. 21A is a diagrammatic illustration of a four-louver louvered section of the louvered shutter of FIG. 13.
Figure 21B:
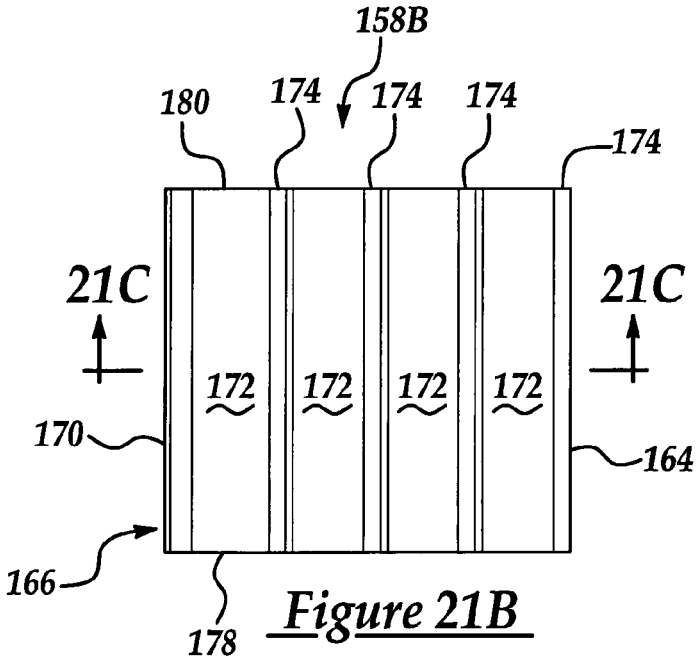
FIG. 21B is a top view of the louvered section of FIG. 21A.
Figure 21C:
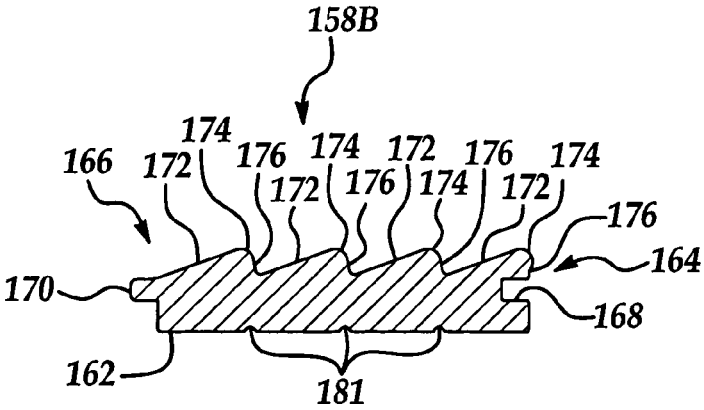
FIG. 21C is a cross sectional view of the louvered section of FIG. 21A.
Figure 22A:
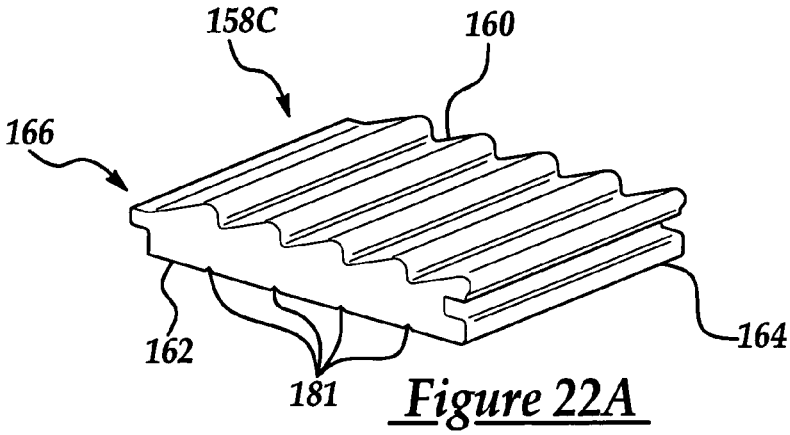
FIG. 22A is a diagrammatic illustration of a five-louver louvered section of the louvered shutter of FIG. 13.
Figure 22B:
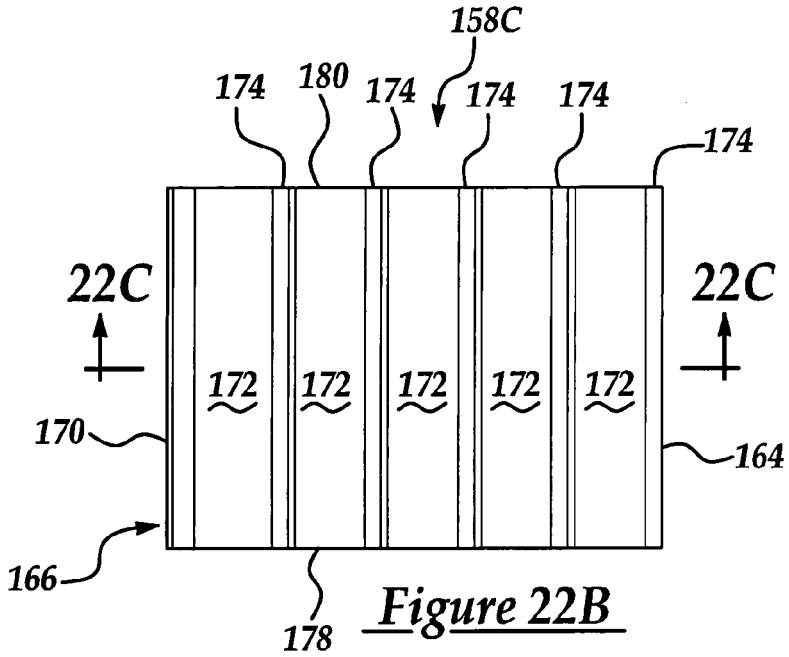
FIG. 22B is a top view of the louvered section of FIG. 22A.
Figure 22C:
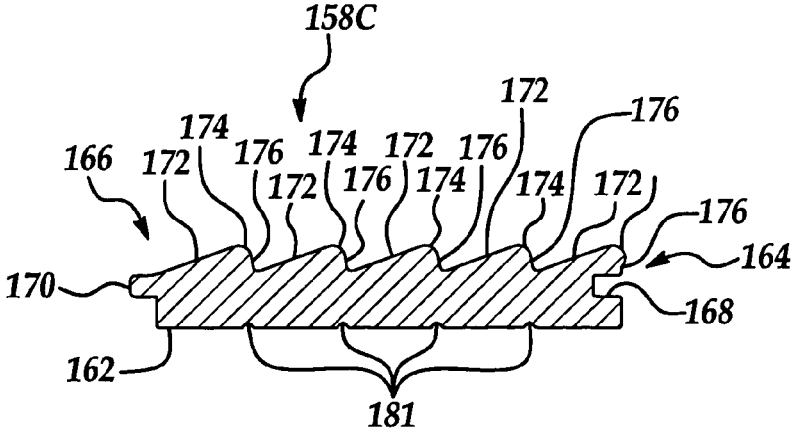
FIG. 22C is a cross sectional view of the louvered section of FIG. 22A.
Figure 23A:
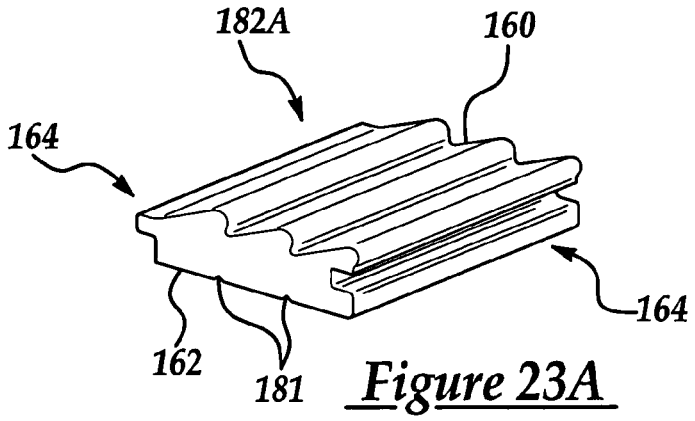
FIG. 23A is a diagrammatic illustration of a three-louvered louvered section, according to an alternative embodiment of the present invention.
Figure 23B:
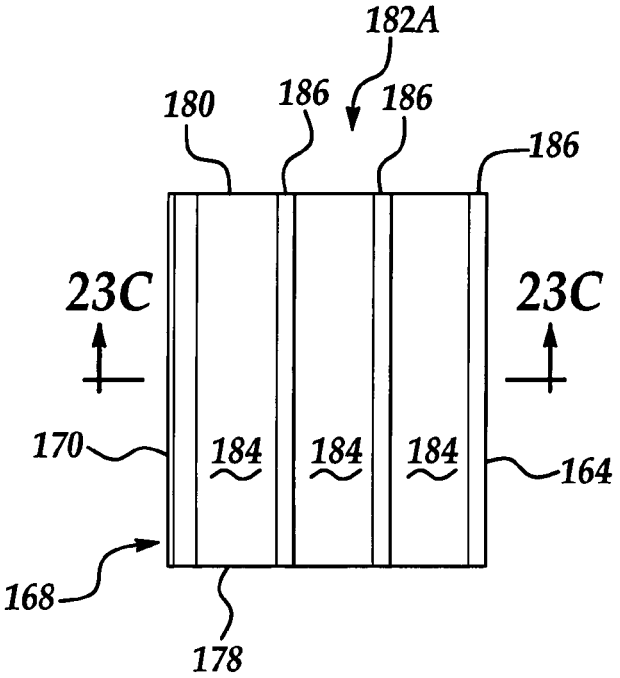
FIG. 23B is a top view of the louvered section of FIG. 23A.
Figure 23C:
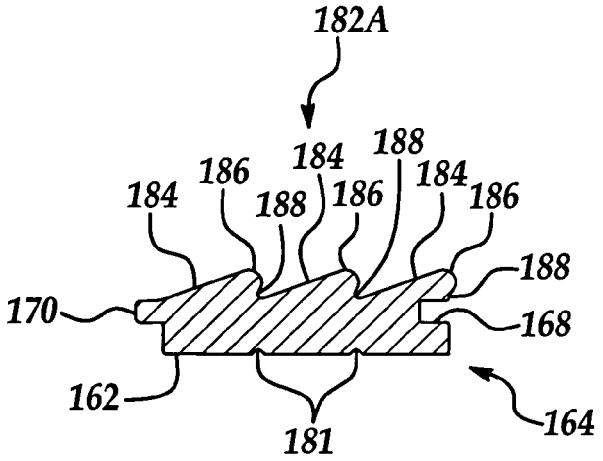
FIG. 23C is a cross sectional view of the louvered section of FIG. 23A.
Figure 24A:
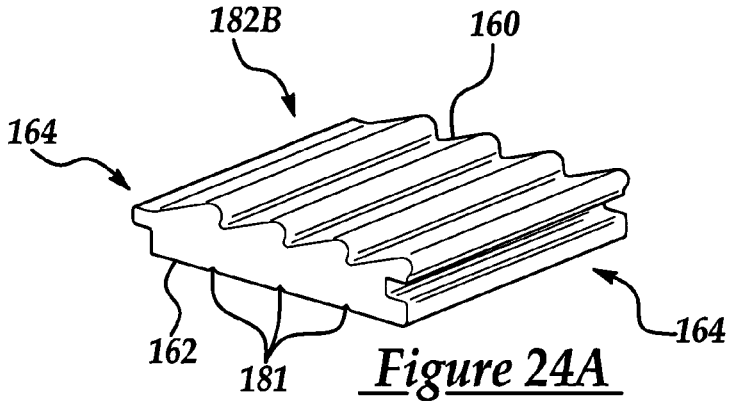
FIG. 24A is a diagrammatic illustration of a four-louvered louvered section according to an alternative embodiment of the present invention.
Figure 24B:
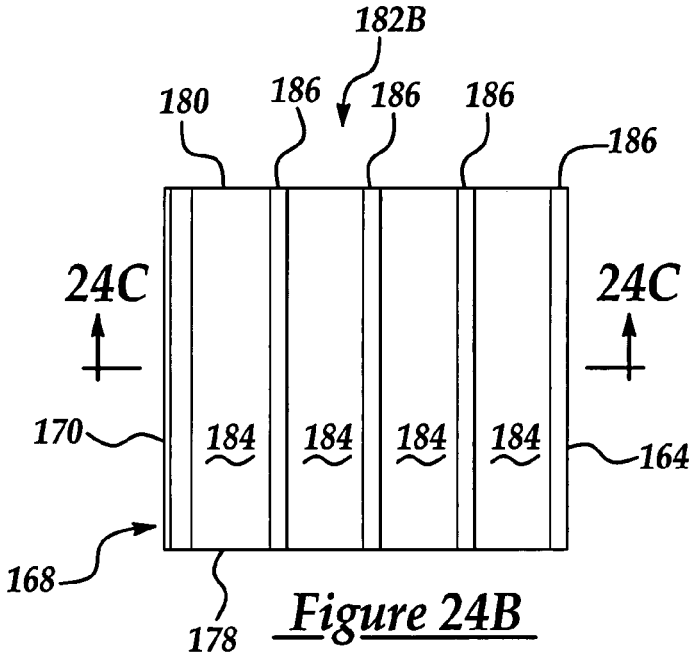
FIG. 24B is a top view of the louvered section of FIG. 24A.
Figure 24C:
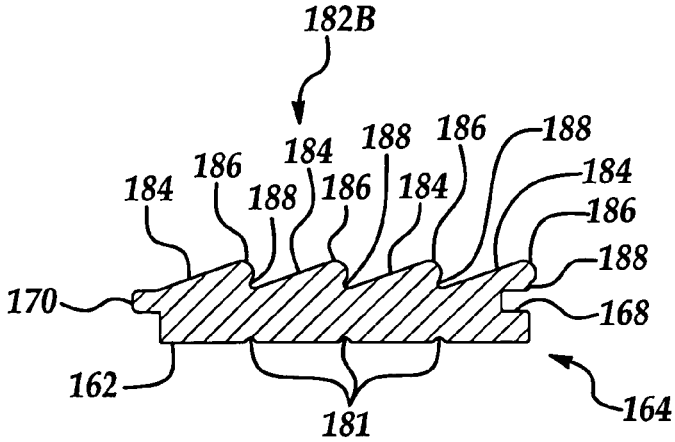
FIG. 24C is a cross sectional view of the louvered section of FIG. 24A.
Figure 25A:
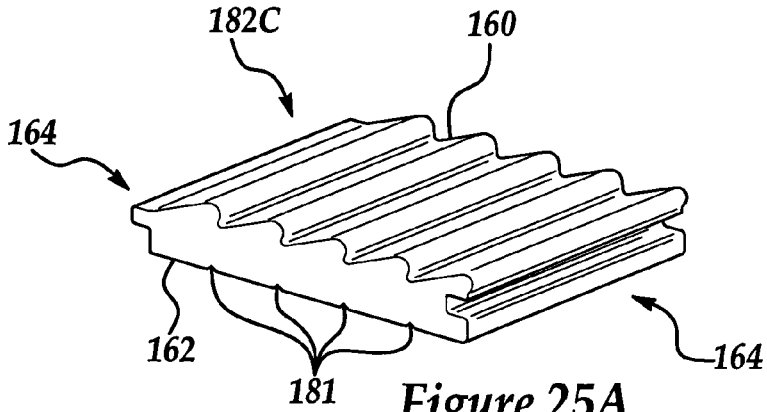
FIG. 25A is a diagrammatic illustration of a five-louvered louvered section, according to an alternative embodiment of the present invention.
Figure 25B:
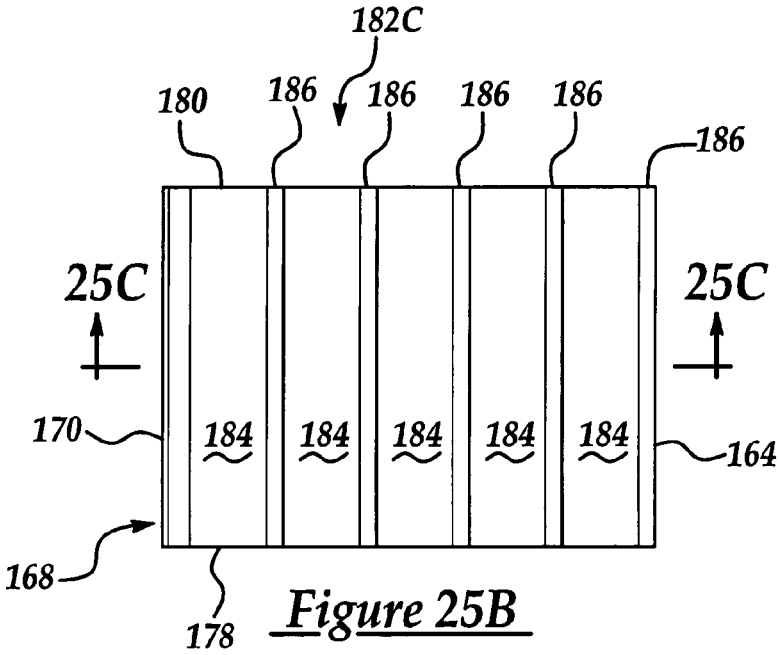
FIG. 25B is a top view of the louvered section of FIG. 25A.
Figure 25C:
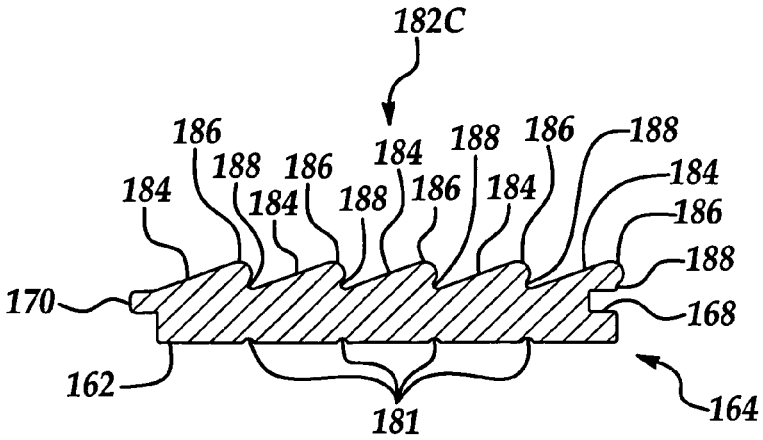
FIG. 25C is a cross sectional view of the louvered section of FIG. 25A.
Figure 26:
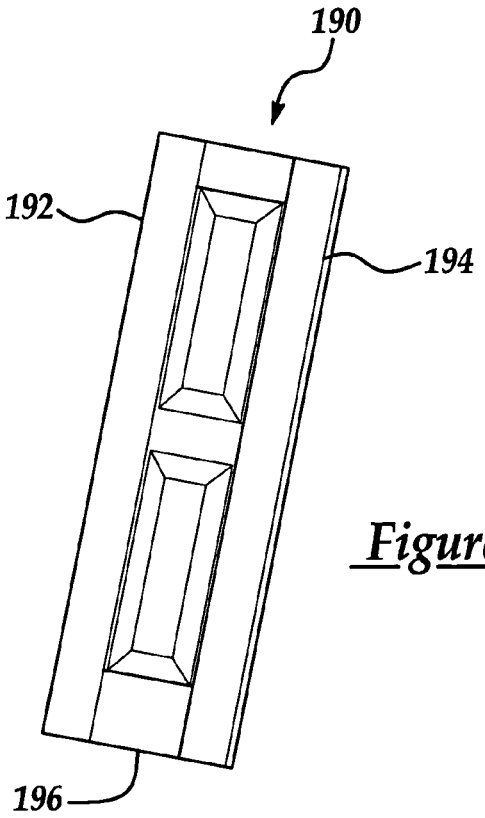
FIG. 26 is a three dimensional view of a paneled shutter, according to an embodiment of the present invention.
Figure 27:
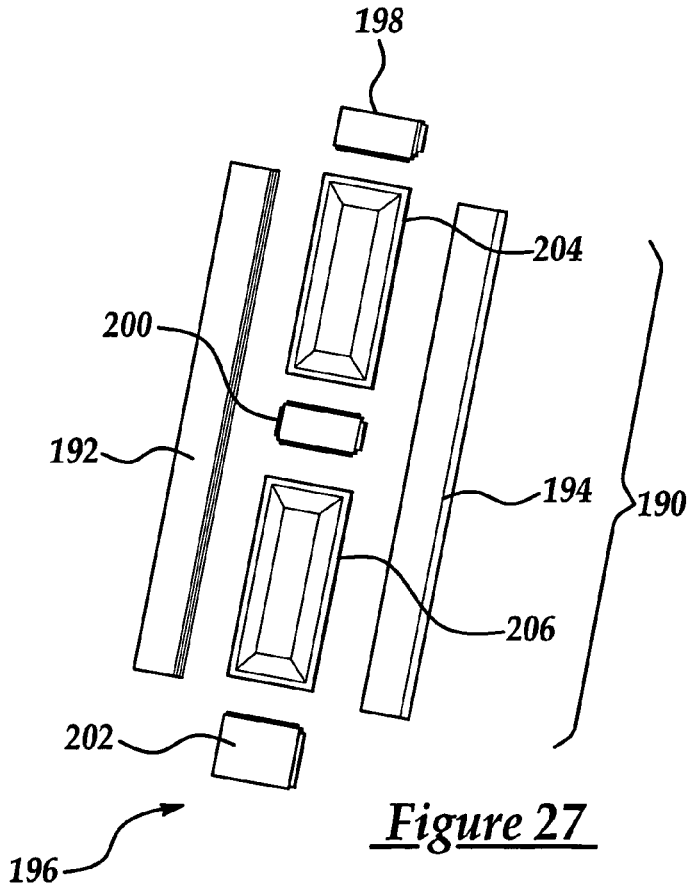
FIG. 27 is an exploded view of the shutter of FIG. 26.

It should be noted that FIGS. 16A, 16B, 16C, 17A, 17B, 17C and 18 show the center rail 68, the bottom rail 70 and the top rail 66 prior to a machining operation for forming tabs (see below) along side edges. In one embodiment, after the top rail, center rail and bottom rail 66, 68, 70 and the louvered sections 72, 74 have been formed, tabs 130, 132 are machined along the sides of each component. In another embodiment, after the center section 64 has been formed by the top rail, center rail and bottom rail 66, 68, 70 and the louvered sections 72, 74, the tabs 130, 132 are machined along the entire length of the center section 64 on first and second sides 134, 136, respectively (see FIG. 19). With reference to FIG. 19, a cross sectional view of the center section 64 is shown.

As discusses above, the louvered sections 72, 74 may be made with a predetermined number of louvers 76, 78. For example, louvered sections 72, 74 may be manufactured with three, four, or five louvers 76,78. This enables louvered shutters 58 to be constructed having varying numbers of louvers. Additionally, the louvers 76, 78 may have a shape designed to give the appearance of individual louvers. The louvers 76, 78 may be formed with or without an undercut (see below).

With reference to FIGS. 20A, 20B, 20C, 21A, 21B, 21C, 22A, 22B and 22C, louvered sections 158A, 158B, 158C, having three, four and five louvers 76, 78 without an undercut are shown. Besides the number of louvers 76, 78, the louvered sections 158A, 158B, 158C are similar. Each louvered section 158A, 158B, 158C includes a front surface 160, a rear surface 162, a bottom side 164 and a top side 166. The bottom side 164 includes a groove or slot 168 which traverses the width of the bottom side 164. The top side 166 includes a tab or tongue 170. The louvers, 76, 78 are formed in the front surface 160. Each louvered 76, 78 includes an inclined surface 172, a radial portion 174 and a vertical surface 176.

Each louvered section 158A, 158B, 158C also includes first and second sides 178, 180. Although not shown in FIGS. 20A-22C, tabs 130, 132 (see FIG. 18) are machined therein.

Grooves 181 may be machined in the rear surface 162, 96, 114 of the louvered sections 158A, 158B, 158C, the center rail 68, and the bottom rail 70. The grooves 181 give the appearance of closed louvers, as well as, hiding or masking the seam between adjacent louvered sections and rails 158A, 158B, 158C, 68,70.

With specific reference to FIGS. 23A, 23B, 23C, 24A, 24B, 24C, 25A, 25B and 25C, louvered sections 182A, 182B, 182C with undercut louvers are shown according to an alternate embodiment of the present invention. As shown each louvered 76, 78 has an incline surface 184, a radial portion 186 and an undercut groove 188.

With reference to FIGS. 26-33B, a panel shutter 190, according to another aspect of the present invention is shown. The panel shutter 190 includes first and second stiles 192, 194 and a center section 196. The center section 196 includes a top rail 198, a center rail 200, and a bottom rail 202. The center section 196 also includes a top panel 204 and a bottom panel 206. In the illustrated embodiment, the top and bottom panels 204, 206 are identical.

Figure 28A:
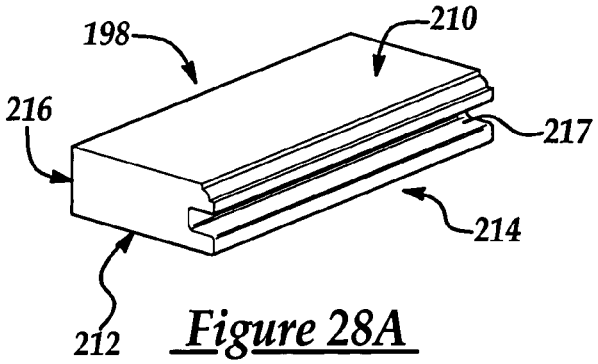
FIG. 28A is a diagrammatic illustration of a top rail of the shutter of FIG. 26.
Figure 28C:
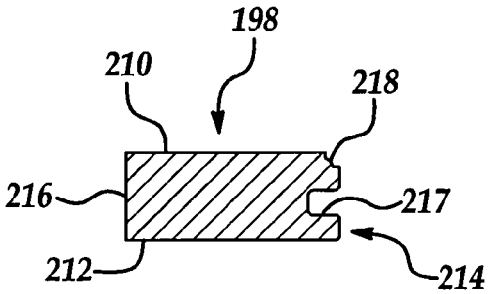
FIG. 28C is a cross sectional view of the top rail of FIG. 28A.
Figure 28B:
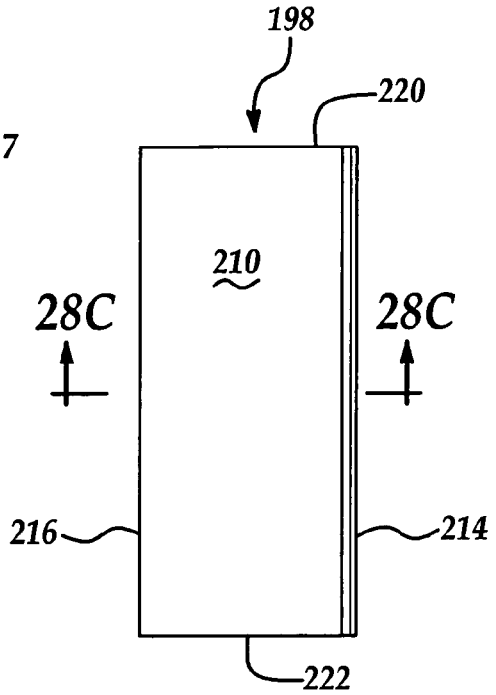
FIG. 28B is a top view of the top rail of FIG. 28A.

With reference to FIGS. 28A, 28B, 28C, the top rail 198 includes a front surface 210, a rear surface 212, a bottom side 214 and a top side 216. The bottom side 214 include a groove 217. The top rail 198 also includes a beveled or beaded edge 218 between the bottom side 214 and the front surface 210. The top rail 198 also includes first and second sides 220, 222 in which are machined tabs (see below). The tabs are not shown in FIGS. 28A, 28B, 28C.

Figure 29A:
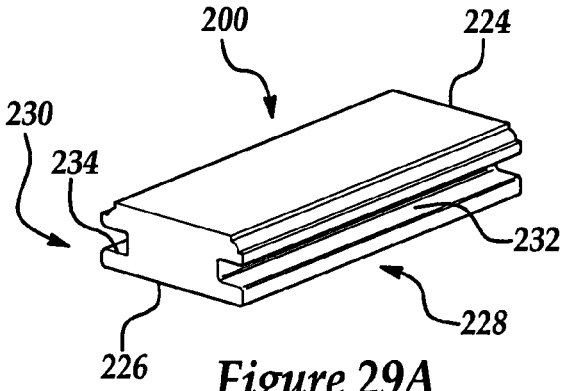
FIG. 29A is a diagrammatic illustration of the center rail of the shutter of FIG. 26.
Figure 29B:
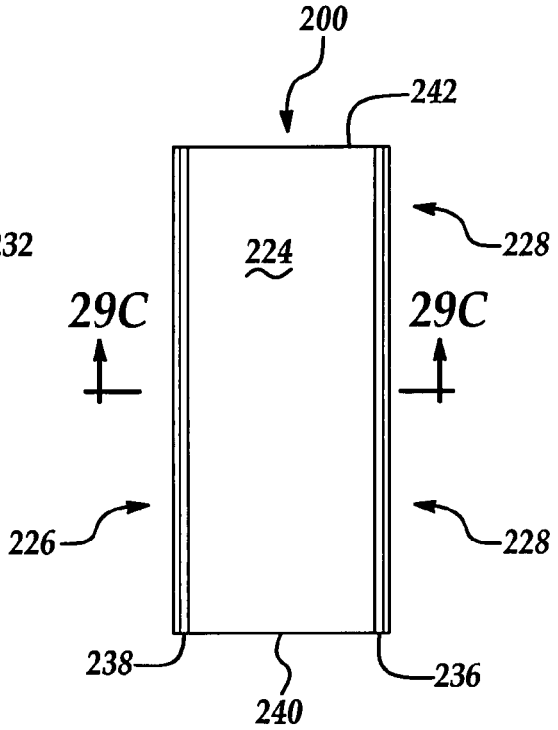
FIG. 29B is a top view of the center rail of FIG. 29A.
Figure 29C:
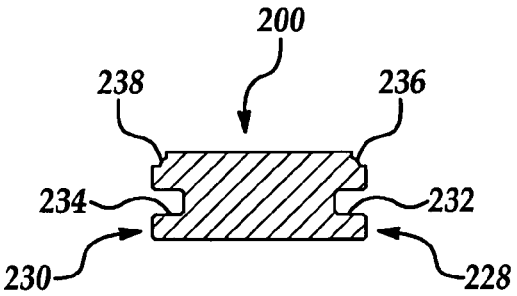
FIG. 29C is a cross sectional view of the center rail of FIG. 29A.

With reference to FIGS. 29A, 29B, 29C, the center rail 200 includes a front surface 224, a rear surface 226, a top side 228 and a bottom side 230. The top side 228 and the bottom side 230 each include a groove 232, 234. The center rail 200 also includes first and second beveled or beaded edges 236, 238 between the front surface 224 and each of the top and bottom side 228, 230. The center rail 200 also includes first and second sides 240, 242 in which are machined tabs (see below). The tabs are not shown in FIGS. 29A, 29B, 29C.

Figure 30A:
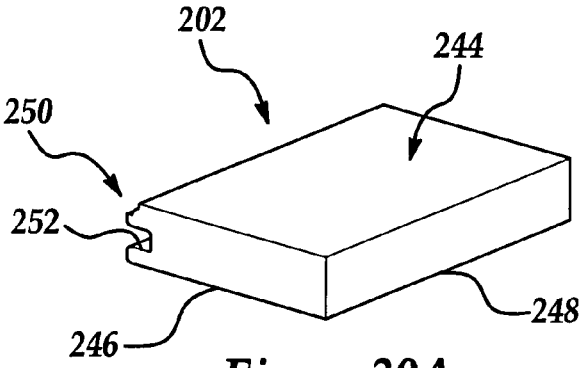
FIG. 30A is a diagrammatic illustration of a bottom rail of the shutter of FIG. 26.
Figure 30B:
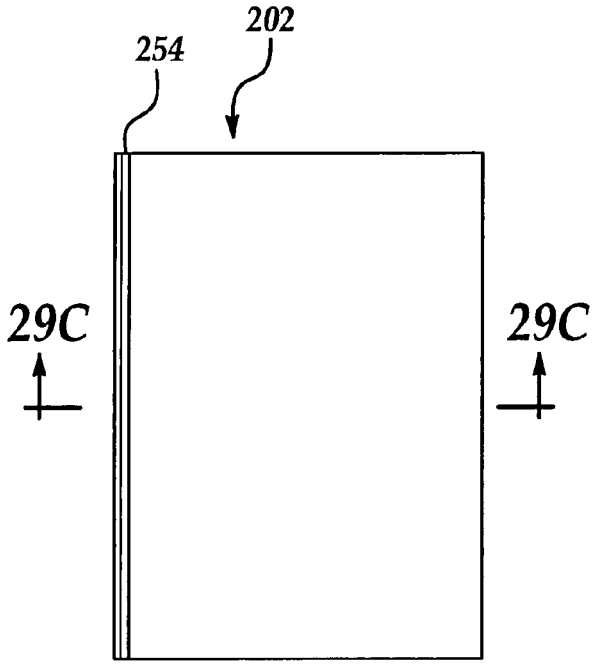
FIG. 30B is a top view of the bottom rail of FIG. 30A.
Figure 30C:
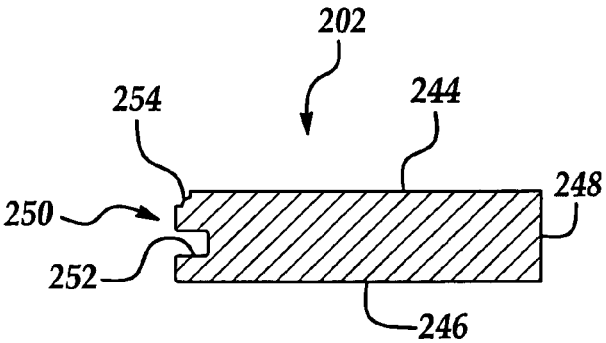
FIG. 30C is a cross sectional view of the bottom rail of FIG. 30A.

With reference to FIGS. 30A, 30B, 30C, the bottom rail 202 includes a front surface 244, a rear surface 246, a bottom side 248 and a top side 250. The top side 250 include a groove 252. The bottom rail 202 also includes a beveled or beaded edge 254 between the bottom side 248 and the front surface 244. The bottom top rail 202 also includes first and second sides 256, 258. in which are machined tabs (see below). The tabs are not shown in FIGS. 30A, 30B, 30C.

Figure 31:
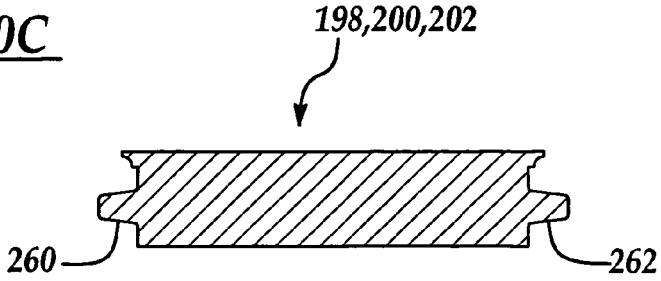
FIG. 31 is a side profile of rails of the shutter of FIG. 26.

FIG. 31 represents a cross-sectional view of the top, center and bottom rails 198, 200, 202, after tabs 260, 262.

Figure 32:
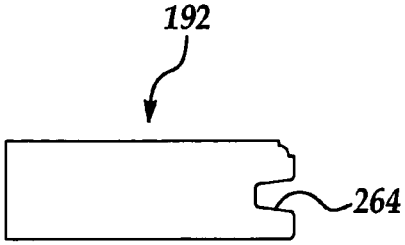
FIG. 32 is a profile view of a stile of the shutter of FIG. 26.

With reference FIG. 32, the first stile 192 is shown with a groove 264. The second stile 194 is a mirror of the first stile 192.

Figure 33B:
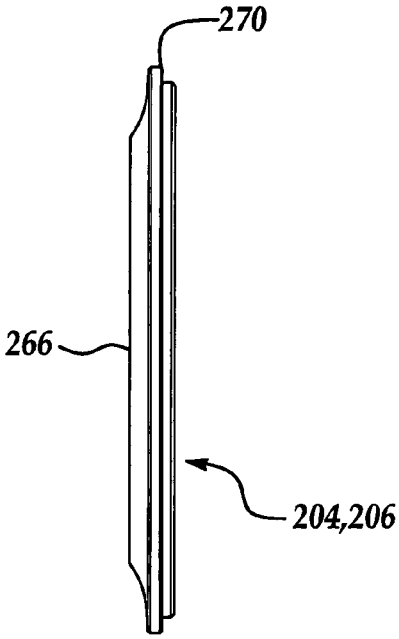
FIG. 33B is a side view of the panel of FIG. 33A.
Figure 33A:
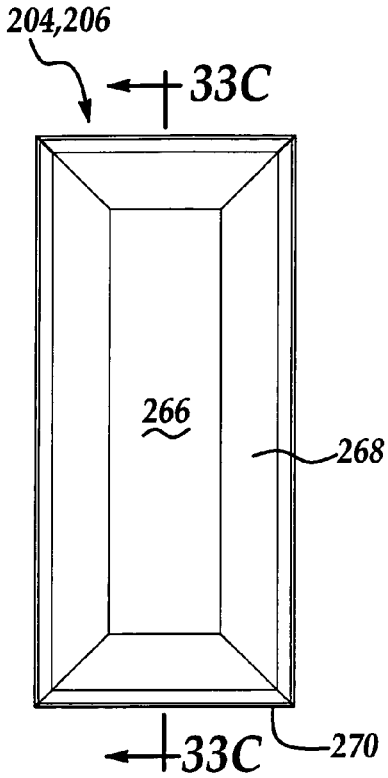
FIG. 33A is a top view of a panel of FIG. 26.
Figure 33C:
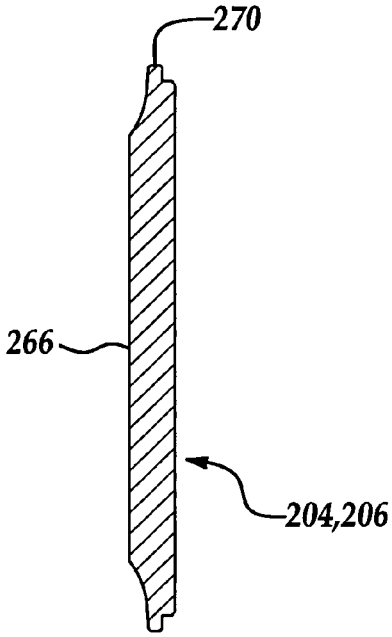
FIG. 33C is a cross-sectional view of the panel of FIG. 33A

With reference to FIGS. 33A, 33B, 33C, in the illustrated embodiment the top and bottom panels 204, 206 include a raised panel surface 266 and a curved portions 268 adjacent the raised panel surface 266 and extending towards the sides of the panels 204, 206. Each side of the panels 204, 206, edges in a tab 270 which extends around the panels 204, 206.

The shutters 18, 58, 190 may be made from any material capable of being machined. For example, the shutters 18, 58, 190 may be made from wood or an exterior grade composite wood product. The components of the shutters 18, 58, 190 are machined from the chosen material, sanded, primed and painted.

In a first step, sheets of the material are cut to length of various widths for each of the different components. In one embodiment, the material is cut using a panel saw.

In a second step, the edges and surfaces of each component is machined using a molder and cutting tools.

For the undercut louvered sections 182A, 182B, 182C the undercut groove 188 is then routed using a custom shaped router bit (not shown).

In one embodiment, the louvered sections 156A, 156B, 156C, 182A, 182A, 182B, 182C may be formed using a multi-router power feed shaper which machines each of the louvers simultaneously. Two passes may be needed to preform the louvers and to machine the undercut groove 188. The louvered sections 156A, 156B, 156C, 182A, 182A, 182B, 182C may be pre-made or pre-made with various predetermined number of louvers. This enables shutters with various lengths to be made using the pre-formed or pre-made louvered sections 156A, 156B, 156C, 182A, 182A, 182B, 182C.

For the panel shutter 190, the panels 204, 206 are machined using a shaper/sander.

In a third step, the linear components, i.e., the stiles 60, 62, are then cut to length. In a fourth step, the tabs and grooves 88, 102, 106, 120, 130, 132, 146, 168, 170, 217, 232, 234, 252, 260, 262 are machined.

In a fifth step, the components of the shutter 18, 58, 190 are assembled, e.g., by inserting the tabs into the corresponding slot or groove and affix by using an adhesive, and then clamped together. Then, the ends of the shutter 18, 58, 190 may then be trimmed to achieve the final length and/or width. Some of the edges of the assembled shutter 18, 58, 190 may need additional machining to form, e.g., bezeled edges. The assembled shutter 18, 58, 190 may then be inspected, sanded, primed, and painted.

Other aspects and features of the present invention can be obtained from a study of the drawings, the disclosure, and the appended claims.

What is claimed is:

1. A method of manufacturing a modular shutter assembly comprising the steps of:

machining a first simulated louver across a center section and longitudinally through opposite first and second sides of the center section;

connecting first and second stiles to the respective first and second sides of the center section; and machining a second simulated louver across the center section that is parallel to the first simulated louver prior to said step of connecting the first and second stiles, and wherein the first simulated louver has a sloped portion and the second simulated louver has a curved portion cantilevered over the sloped portion and defining a relief there between that communicates through the first and second sides.

2. The method of manufacturing set forth in claim 1 further comprising the steps of forming mating joints carried respectively between the first and second sides of the center section and respective sides of the first and second stiles.

3. The method of manufacturing set forth in claim 2 wherein the steps of forming mating joints is further defined as forming a tongue on each of the first and second sides of the center section and forming a groove in each of the respective sides of the first and second stiles to receive the tongues.

4. The method of manufacturing set forth in claim 1 wherein machining the first and second simulated louvers is further defined as machining the first and second simulated louvers on a front surface of the center section and further comprising forming a plurality of grooves on an opposite rear surface of the center section to simulate closed louvers on the opposite rear surface.

5. The method of manufacturing set forth in claim 1 further comprising the step of machining a top rail and flat transition portion extending from the top rail to the second simulated louver and prior to connecting the first and second stiles, and wherein the second simulated louver has a sloped portion extending from the curved portion of the second simulated louver to the flat transition portion.

6. The method of manufacturing set forth in claim 1 further comprising the step of forming a bottom rail and a ramped transition portion extending from the bottom rail to the first simulated louver and prior to connecting the first and second stiles, and wherein the first simulated louver has a curved portion cantilevered over the ramped transition portion and extending from the sloped portion of the first simulated louver to the ramped transition portion.

* * * * *